United States Patent [19]

Harris

[11] 4,317,486

[45] Mar. 2, 1982

[54] CEMENTING HEAD APPARATUS AND METHOD OF OPERATION

[75] Inventor: Monty E. Harris, Cleveland, Okla.

[73] Assignee: The Dow Chemical Company, Midland, Mich.

[21] Appl. No.: 128,798

[22] Filed: Mar. 10, 1980

[51] Int. Cl.[3] ..... E21B 33/05

[52] U.S. Cl. ..... 166/250; 166/70; 166/95; 166/113; 166/291

[58] Field of Search ..... 166/70, 75 R, 84, 95, 166/153, 113, 285, 291, 250; 15/104.06 A, 104.06 B, 104.05; 137/268

[56] References Cited

U.S. PATENT DOCUMENTS

| | | | |
|---|---|---|---|
| 2,481,422 | 9/1949 | Haynes et al. | 166/70 X |
| 2,662,602 | 12/1953 | Schnitter | 166/291 X |
| 3,076,509 | 2/1963 | Burns et al. | 166/70 |
| 3,175,240 | 3/1965 | Hillard | 15/104.06 A |
| 3,216,500 | 11/1965 | Diehl | 166/70 |
| 3,322,197 | 5/1967 | Baker et al. | 166/70 X |
| 3,412,798 | 11/1968 | Gregston | 166/153 X |
| 3,444,928 | 5/1969 | Pitts | 166/70 |
| 3,828,852 | 8/1974 | Delano | 166/70 X |

*Primary Examiner*—Stephen J. Novosad
*Attorney, Agent, or Firm*—V. Dean Clausen

[57] ABSTRACT

A cementing head is disclosed, which is particularly designed for injecting an omega-type cementing plug into a well casing. Prior to cementing, the plug is retained in a housing. Located above the plug is a movable plunger, actuated by an operating fluid, such as hydraulic fluid. Below the plug is a control valve. When the valve is closed, it prevents any accidental downward movement of the plug into the well casing. Following injection of the cement slurry into the casing, the valve is opened, and the plunger is moved down to push the plug through the valve and beyond the cement inlet. A fluid such as water is passed through the cement inlet, under pressure, to push the plug down the casing behind the cement slurry.

8 Claims, 5 Drawing Figures

CEMENTING HEAD APPARATUS AND METHOD OF OPERATION

BACKGROUND OF THE INVENTION

The invention relates broadly to an apparatus and method for cementing of a well casing in a bore hole. More specifically, the invention covers a cementing head for injecting a cementing plug into the well casing. The cementing head described herein is particularly suited for injecting cementing plugs of an omega design into a well casing.

In a typical well cementing operating, a bottom cementing plug is introduced into the well casing ahead of the cement slurry. After the desired amount of cement slurry has been injected, another plug, usually called a top plug, follows immediately behind the slurry column as it travels down the well casing. The function of the top and bottom plugs is to separate the cement slurry column from drilling muds and other fluids which can contaminate the slurry. A fluid, such as drilling mud, is then pumped into the casing behind the top plug to push the cement slurry through the casing and up into the annulus between the casing and the bore hole.

The cementing heads presently in use for injecting cementing plugs into a well casing are not entirely satisfactory. One reason is that most of the cementing heads now in use require the presence of an operator on the rig floor to inject the plug into the well casing, at the appropriate time, using a manual procedure. Because these cementing heads do not have a positive means for indicating that the plug has been injected into the casing, it can create a very hazardous situation for the operator if the plug should hang up in the head itself, or inside the casing. In addition to being unsafe, the situation described above can result in the waste of a substantial amount of material (cement slurry), and a waste of time required to shut down the operation and clean up the equipment.

SUMMARY OF THE INVENTION

The cementing head of this invention includes a fluid chamber adapted for receiving an operating fluid. The operating fluid is carried into the fluid chamber through an inlet which communicates with the inside of the chamber and also with a source for the operating fluid. A plug housing is coupled into the bottom end of the fluid chamber. This housing acts as a retainer for holding the cementing plug in the head apparatus prior to injection into the well casing. Another component of the cementing head is a plunger, which is positioned inside the fluid chamber and it is movable, by the action of the operating fluid, between a rest position and an extended position.

At its bottom end the plug housing is coupled into a valve housing and the valve housing, in turn, connects into the well casing. A control valve is installed inside the valve housing. The control valve has a lengthwise bore through the body of the valve and the valve itself can be moved between a closed position and an open position. An inlet for cement is mounted on the valve housing below the control valve. During the cementing operation, a cement slurry is carried into the well casing through the cement inlet. Following discharge of the cement slurry into the casing, the control valve is opened and the plunger is moved by the action of the operating fluid to its extended position. As the plunger moves to the extended position, it pushes the cementing plug through the bore in the open valve, such that the plug comes to rest below the cement inlet.

DESCRIPTION OF THE PREFERRED EMBODIMENTS

Figures 1A, 1B:
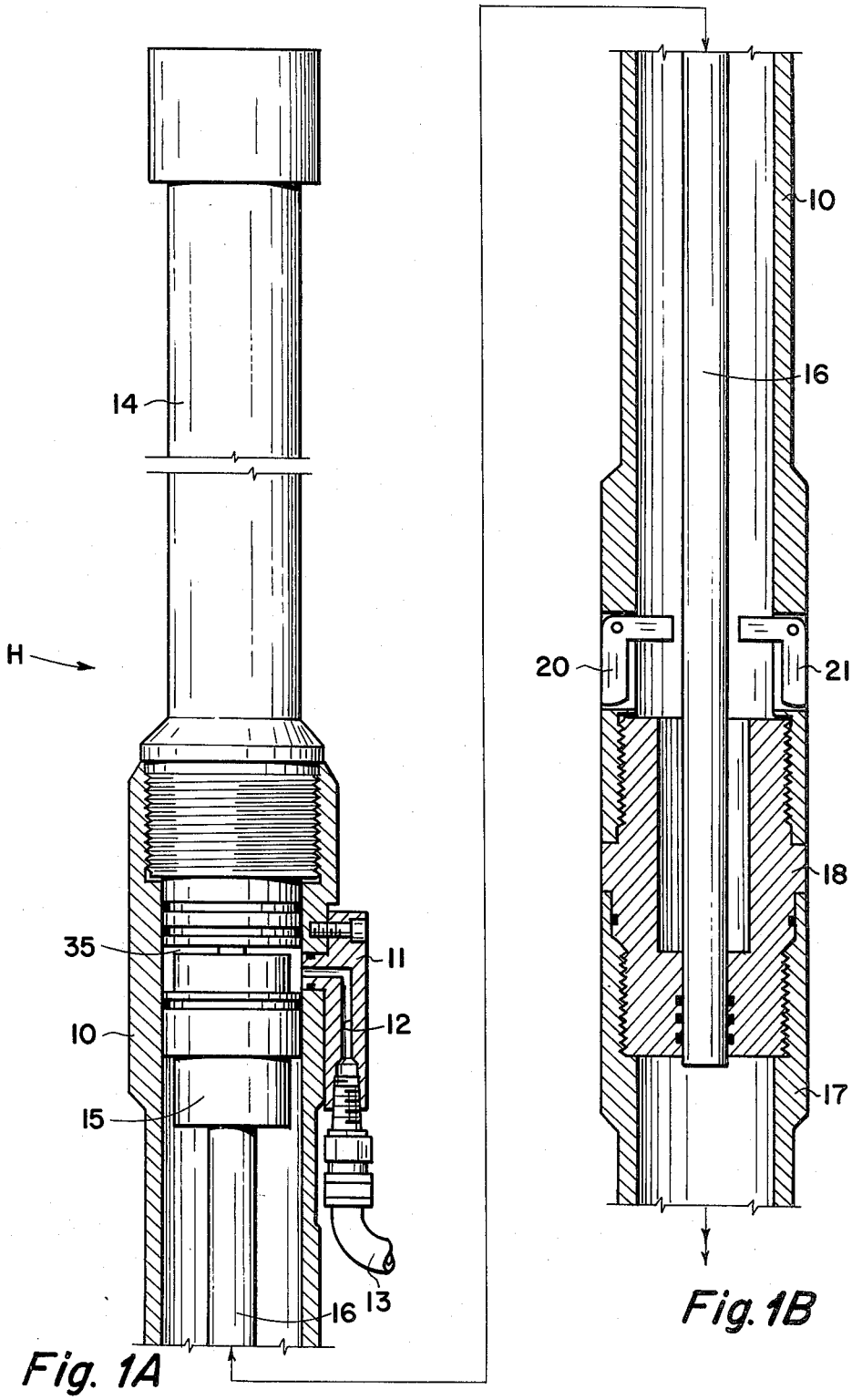
FIGS. 1A, 1B, and 1C, taken together, comprise an elevation view, mostly in section, of the cementing head apparatus of this invention. In this view, the cementing plug is in its "retained" position within the cementing head, which is the normal position of the plug prior to injecting the cement slurry into the well casing.

In the drawings, the cementing head of this invention is indicated generally by the letter "H". The basic structure of the cementing head is made up of a fluid chamber, a plug housing, a plunger, and a control valve. The fluid chamber 10 provides means for receiving the operating fluid to operate the plunger. A flange 11, of a generally rectangular shape, is fastened on to the fluid chamber 10 at the top end of the chamber. A right angle bore 12 is drilled through the flange 11 to provide a passage for carrying the operating fluid into the chamber 10. The upper end of bore 12 opens into the fluid chamber 10 and the lower end of the bore is connected into a fluid inlet line 13. The opposite end of line 13 is connected into a source for the operating fluid. The operating fluid and its source are not shown in the drawings.

A lift sub 14 is coupled into the top end of the fluid chamber 10. The sub provides a means for lifting the cementing head "H" into its operating position on the well casing, and for removing the head from the casing. The plunger is defined by a head member 15 and a rod 16, which depends from the head. As shown in the drawing, the plunger fits inside the fluid chamber 10 and it is movable up and down within the chamber. The plug housing 17 is positioned below the fluid chamber 10. The bottom end of chamber 10 is threaded into an adapter coupling 18, which, in turn, is threaded into the top end of a valve housing 19.

At the bottom end of the fluid chamber 10 are mounted two flag members 20 and 21. Each flag is fastened into the chamber 10 by a roll pin, such that the flags are on the opposite sides of the plunger rod 16. The purpose of these flags is to provide a visible signal means to indicate that the cementing plug is in position to follow the cement slurry into the well casing. This function is explained in greater detail in this description. Prior to its injection into the well casing, the cementing plug 22 is retained in the plug housing 17.

A control valve installed in the valve housing 19 provides a positive means for controlling injection of the plug 22 into the well casing at the appropriate time. The basic structure of the control valve consists of a ball 23, with a central bore **23*a*, which extends lengthwise through the ball. Also, on one side of ball 23, is a flat surface which defines a side face 23*b*. Means for operating the valve is provided by a control shaft 24. The inner end of shaft 24 fits into a crosswise slot (not numbered) in the side face 23***b* of the ball. The outer end of the control shaft is keyed to a hub 25, and the hub is, in turn, mounted flush to the outside of the valve housing and held in place by a hex socket bolt 26.

Figure 1C:
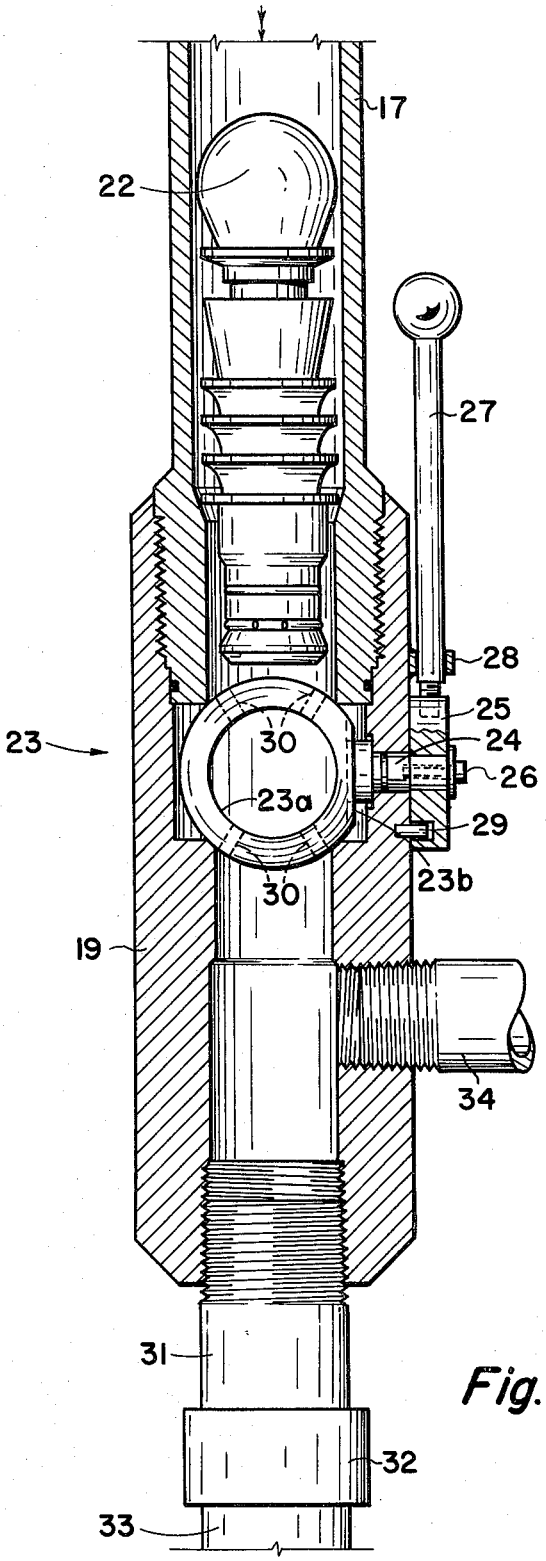

An ear member 28 is mounted on the outside of the valve housing 19 just above the hub 25. A control handle 27 threads into a hole (not shown) on the top side of hub 25. When the control valve 23 is in its closed position, as shown in FIG. 1C, the handle 27 extends through an opening indicated by numeral 28*a* in FIG. 2B, in the ear member 28. With handle 27 in this position, the valve is locked into its closed position. To unlock the valve 23, the handle 27 is unscrewed from the top hole in hub 25 and pulled through the hole 28*a* in the ear member. The handle is then rethreaded into a second hole (not shown) in the hub 25.

Figures 2A, 2B:
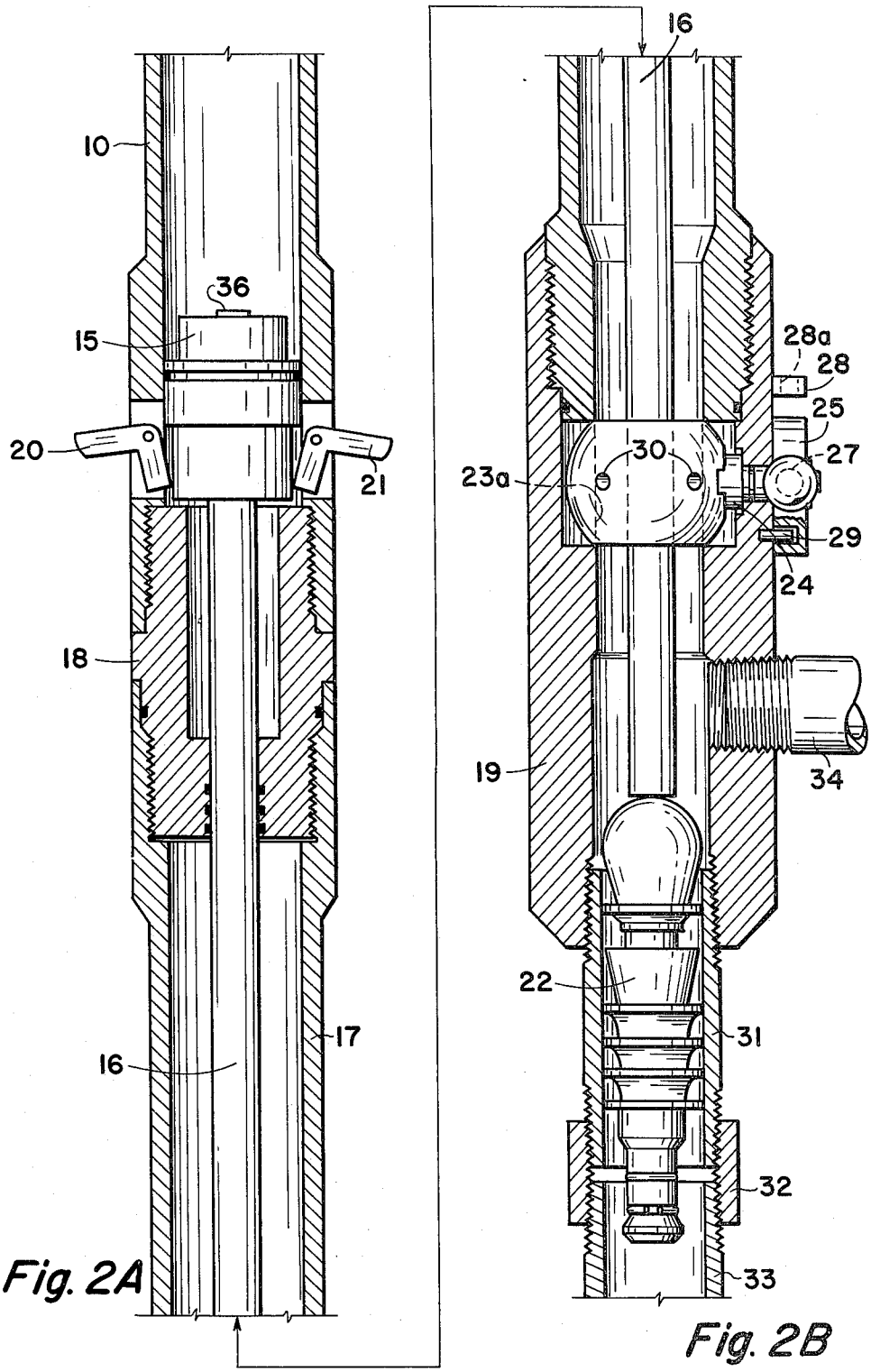
FIGS. 2A and 2B, taken together, comprise a partial elevation view, mostly in section, of the apparatus shown in FIG. 1. In this view, which is after the cement slurry has been delivered into the well casing, the cementing plug is in its normal position below the cement inlet, after having been pushed through the open control valve by the extended plunger.

With the handle 27 in the second hole in the hub, the handle can be used to rotate the hub 25 a quarter turn, to move the valve 23 to its open position, as shown in FIG. 2B. Along the bottom of the hub 25 is a slot with a quarter circle configuration (not numbered). This slot encloses a fixed pin 29, which is mounted on the outside of the valve housing 19. Opposite ends of this slot thus provide a travel limit for the hub 25, to insure that the valve 23 will not rotate beyond its fully closed position, as shown in FIG. 1C, or its fully open position, as shown in FIG. 2B.

The ball valve 23 also includes four "pressure relief" holes, as indicated by numeral 30. As best shown in FIG. 1C, two of the pressure relief holes are drilled through the wall of the valve, at an angle from the centerline on one side of the ball 23. The other two pressure relief holes are drilled through the valve wall on the opposite side of ball 23. The purpose of these holes is to allow fluid to pass through the valve 23, when it is in closed position, to prevent pressure build up and possible seizure of the valve in its seat.

A nipple section 31 threads into the bottom end of the valve housing 19. This nipple is, in turn, connected by a coupling 32 into the well casing 33. A cement inlet line 34 is connected into the valve housing 19 below the valve 23. The opposite end of line 34 is coupled into a cement pump or some other apparatus suitable for delivering a cement slurry into the well casing 33. The cement pumper is not illustrated in the drawing.

OPERATION

The invention can be illustrated by describing a typical cementing operation using the cementing head apparatus described herein. The cementing pump 22, which is a wiper plug of the omega design, is first loaded into the plug housing 17 and the valve 23 is locked into its closed position, as shown in FIG. 1C. Although the cementing head apparatus described herein is particularly designed for injecting an omega plug into a well casing, it can also be used to inject various other types of wiper plugs now in common use. A tubing insert (not shown), which the cementing plug can latch into, is dropped into the well casing 33 prior to mounting the cementing head. The head apparatus "H" is then coupled into the casing and the cement slurry charge is pumped into the well.

After the desired amount of slurry is pumped down the casing 33, the operator cuts off the slurry flow from the pumper. The next step is to remove the valve handle 27 from the top hole in hub 25, pull it out of the ear 28, and thread it into the second hole in the hub. The operator then rotates the hub a quarter turn to open the valve 23, as shown in FIG. 2B. An operating fluid, such as hydraulic fluid, is then directed into the fluid chamber 10 through the bore 12 in flange 11. At this point, as illustrated in FIGS. 1A and 1B, the plunger is in its rest position. When the plunger is in the rest position, there is a small space 35 defined between the top face of the plunger head 15 and the bottom face of the lift sub 14. The space 35 thus provides a relief groove for entry of the operating fluid. The groove 35 is actually defined by the fact that the center part 36, on the top face of plunger head 15, projects above the surrounding surface. This is best shown in the illustration of the head member 15 in FIG. 2A of the drawing.

As the hydraulic fluid flows into chamber 10, and pushes its way into the relief groove 35, it exerts enough pressure to move the plunger downwardly. The downward travel of the plunger rod 16 drives the cementing plug 22 through the opening in the control valve 23. When the rod 16 reaches the bottom of its stroke, the plunger is in its fully extended position, and the plug 22 is resting in the nipple 31 just below the cementing inlet 34. During the downward travel of the plunger, the bottom face of the head member 15 of the plunger hits both of the flag members 20 and 21. This causes each flag to swing outwardly, as noted in FIG. 2A. Each flag thus provides a visual signal that gives the operator a positive indication that the plug 22 is in the desired position below the cementing inlet 34.

The next step is to retract the plunger to its rest position and then force the plug 22 down the well casing behind the cement slurry. The plug is moved down into the casing by flowing water, or some other suitable fluid, under pressure, through the inlet 34. The force of the fluid moves the plug and the slurry column down the casing until the plug latches into the tubing insert positioned in the casing. After a cementing operation is completed, the head "H" can be removed from the casing 33 and re-loaded with another cementing plug to prepare for another cementing operation.

What is claimed is:

1. A cementing head apparatus for injecting a cementing plug into a well casing, the apparatus comprising:

means defining a fluid chamber having top and bottom ends, the chamber being adapted to contain an operating fluid;

means defining a fluid inlet, in communication with the inside of the fluid chamber and a source for the operating fluid, said inlet being adapted to carry the operating fluid into the fluid chamber;

a plug housing having top and bottom ends, the top end being coupled into the bottom end of the fluid chamber, the plug housing being adapted for retaining a cementing plug;

a plunger, the plunger being positioned inside the fluid chamber, and the plunger being movable in said chamber, by the action of the operating fluid, between a rest position and an extended position;

a valve housing having top and bottom ends, the top end being coupled into the bottom end of the plug housing; and the bottom end being coupled into the well casing;

a control valve having a bore therein, said valve being installed inside the valve housing, and the valve being movable in the housing between a closed position and an open position;

a cement inlet, mounted on the valve housing below the control valve, coupled into a source for a cement slurry, and adapted for carrying the slurry into the valve housing;

wherein, the wiper plug is adapted to be pushed through the valve bore by the plunger, by moving the control valve to its open position and moving the plunger to its extended position.

2. The cementing head of claim 1 in which the plunger is defined by a head member and a rod depending from the head member.

3. The cementing head of claim 1 which includes a signal means for indicating that the plunger has reached its extended position.

4. The cementing head of claim 3 in which the signal means is defined by a pair of arms, each arm being hinged to the wall of the fluid chamber, on opposite sides of the plunger, the head member of the plunger being adapted to contact each arm, and swing it outwardly from the chamber, as the plunger moves to its extended position.

5. The cementing head of claim 1 in which the fluid inlet is defined by a flange member, which is fastened to the outside of the fluid chamber near the top end of said chamber, the flange having a fluid passage therein which communicates with the inside of the fluid chamber and the operating fluid source.

6. The cementing head of claim 1 in which the head member of the plunger has a top face with a central portion thereon which projects above the surrounding surface.

7. Method for injecting a cementing plug into a well casing behind a cement slurry, the method comprising the steps of:

positioning a cementing plug in the plug housing of a cementing head apparatus;

injecting a predetermined amount of a cement slurry into the well casing through a cement inlet positioned in a valve housing, the valve housing being installed in said apparatus below the cementing plug;

opening a control valve installed in the valve housing;

directing an operating fluid against a movable plunger installed in a fluid chamber positioned in said apparatus above the cementing plug;

causing the plunger to move into contact with the cementing plug;

further moving the plunger, by the action of the operating fluid, to cause it to push the cementing plug through the open control valve and into a position below the cement inlet.

8. The method of claim 7 which includes the steps of:

contacting a signal means positioned in the fluid chamber with the movable plunger; and thereby causing the signal means to swing outwardly from the fluid chamber, to indicate that the plunger has pushed the cementing plug through the open control valve.

* * * * *